US006190162B1

(12) United States Patent
Smith et al.

(10) Patent No.: US 6,190,162 B1
(45) Date of Patent: Feb. 20, 2001

(54) INFRARED HEATER AND COMPONENTS THEREOF

(75) Inventors: Thomas M. Smith, Cinnaminson, NJ (US); Walter J. Sherwood, Jr., Scotia, NY (US)

(73) Assignee: Marsden, Inc., Pennsauken, NJ (US)

( * ) Notice: Under 35 U.S.C. 154(b), the term of this patent shall be extended for 0 days.

(21) Appl. No.: 09/248,583

(22) Filed: Feb. 11, 1999

(51) Int. Cl.[7] ..... F23D 14/14; F23D 14/16

(52) U.S. Cl. ..... 431/328; 431/329; 428/163; 428/293.4; 428/300.1; 428/297.4

(58) Field of Search ..... 431/326, 328, 431/329; 428/163, 293.4, 300.1, 297.4

(56) References Cited

U.S. PATENT DOCUMENTS

| | | | | |
|---|---|---|---|---|
| 3,161,227 | * | 12/1964 | Goss | 431/328 |
| 3,199,573 | * | 8/1965 | Flynn | 431/329 |
| 3,407,024 | * | 10/1968 | Hirschberg et al. | 431/328 |
| 3,857,669 | * | 12/1974 | Smith et al. | 431/328 |
| 3,857,670 | * | 12/1974 | Karlovetz et al. | 431/329 |
| 4,224,018 | | 9/1980 | Smith | 431/328 |
| 4,589,843 | | 5/1986 | Smith | 432/59 |
| 4,722,681 | | 2/1988 | Smith | 431/7 |
| 4,830,651 | | 5/1989 | Smith | 65/120 |
| 5,024,596 | | 6/1991 | Smith | 431/328 |
| 5,157,880 | | 10/1992 | Rotenberg et al. | 51/358 |
| 5,165,887 | | 11/1992 | Ahmady | 431/329 |
| 5,409,375 | * | 4/1995 | Butcher | 431/328 |
| 5,464,346 | | 11/1995 | Derr et al. | 431/328 |
| 5,638,779 | * | 6/1997 | Atmur et al. | 123/65 BA |
| 5,989,013 | * | 11/1999 | Gray | 431/328 |
| 6,001,436 | * | 12/1999 | Strasser et al. | 428/293.4 |
| 6,007,329 | * | 12/1999 | Meyer | 431/328 |

FOREIGN PATENT DOCUMENTS

| | | | | |
|---|---|---|---|---|
| 85/01014 | * | 3/1985 | (WO) | 428/163 |

OTHER PUBLICATIONS

Long, Forrest; Alzeta Corporation Research, "Radiant Output", CECC News (Jan. 1997).

Starfire Systems—Web Cite (www.starfire.com) (Dec. 1998).

Industrial Heating (BNP Publishing) Journal of Thermal Technology (Apr. 1993).

Continous Fiber Ceramic Composite Program—Web Cite (www.ms.ornl.gov/cfcc/particip.htm) (Sep. 1998).

Allied Signal—Radiant Burner Screens—Web Cite (www.dlcomposites.com/ess/radiant.htm and www.dlcomposites.com/info/dlcmat.htm) (Sep. 1998).

* cited by examiner

*Primary Examiner*—Ira S. Lazarus
*Assistant Examiner*—Sara Clarke
(74) *Attorney, Agent, or Firm*—Connolly Bove Lodge & Hutz LLP

(57) ABSTRACT

A new infrared heater containing a gas fired burner having a metallic burner body with a combustion plenum chamber, a matrix which covers the combustion mixture plenum and a screen made of fibers treated with a silicon carbide. The screen could be connected to the matrix by a pressure fit. The invention also relates to a new matrix that is energy efficient and made from fibers ceramic or metallic, treated with a pre-ceramic polymer containing silicon and carbon to rigidize the matrix and increase its emittance. The matrix could also have a variety of surfaces that are also more efficient.

18 Claims, 3 Drawing Sheets

INFRARED HEATER AND COMPONENTS THEREOF

BACKGROUND OF THE INVENTION

Infrared ("IR") heaters are used in equipment for treating substrates such as in the drying of paper. Particularly effective IR heaters are described in U.S. Pat. Nos. 4,722,681, 5,024,596; 4,589,843; 5,464,346; 4,224,018; 4,604,054; 4,654,000; 4,500,283; 4,443,185; 4,474,552; 4,416,618; 4,447,205 and 4,378,207 which are incorporated herein in their entirety for all purposes by reference thereto.

U.S. Pat. No. 4,722,681 describes a IR heater body having a plenum chamber divided by a baffle into an unbaffled upstream intake compartment and a baffled downstream intake compartment. The matrix permits a gaseous combustion mixture to pass through the matrix and as said mixture emerges, said mixture is burned to heat emerging surface to incandescene. A matrix is located at the downstream end of the downstream intake compartment. The matrix is disclosed as being made from ceramic fibers about one inch thick and is adhesively secured to the side walls of the IR heater body. The matrix is formed as a block wherein its side walls are perpendicular to its top and bottom walls. The matrix fits against the comparably shaped end portions of the side walls of the IR heater body.

Another particularly effective IR heater is described in U.S. Pat. No. 5,464,346. As shown and described therein, an infrared heater for treating substrates comprises a gas fired IR heater having a body with a plenum chamber divided by a baffle into an unbaffled upstream intake compartment and a baffled downstream intake compartment. A gas inlet communicates with the upstream intake compartment for supplying a fuel-gas mixture. A fiber matrix is located at the mount or discharge end of the downstream intake compartment. The burner body includes peripheral side walls having downstream end portions which surround the matrix. The end portions and the matrix are outwardly tapered in the discharge direction.

There has been a need to develop an improved IR heater with a more durable and highly emittance fiber matrix. There also has been a need to develop a IR heater that can reduce the flame displacement effect of air impingement and improve fuel efficiency. There further has been a need to develop an improved IR heater that would not need a screen. Additionally, there has been a need to develop a IR heater that would have a screen forced fit without the IR heater need of a fastening means such as screws. Also, there has been a need to develop an IR that would have a removable screen. Furthermore, there has been a need to develop a high emittance, non-metallic reverbatory screen that would help the IR heater to emit more energy over the same surface area. Therefore, the same IR energy output would require a lower emitter operating temperature which would reduce the pollution, and improve the efficiency.

SUMMARY OF THE INVENTION

An object of this invention is to meet the above needs by providing a new IR heater, matrix and screen.

The present invention relates primarily to an apparatus and methods for treating substrates such as webs of paper, textile and non-wovens which are heat treated during or after their manufacture. The present invention also relates to a process to make a matrix and screen. It is to be understood that when the term screen is discussed below, that screen could be in the form of (a) an open mesh ceramic fiber screen, (b) open mesh metallic fiber screen or (c) wire screen. In the preferred embodiment the screens are all coated with a pre-ceramic polymer as discussed below.

In accordance with one aspect of this invention the heater includes a open mesh screen made from silicon carbon coated fibers connected to the matrix by a pressure fit. The heater matrix may also be made of silicon carbon material having at least one convoluted surface shape. The convoluted shape preferably has angles in the corrugate from about 60 to about 120 degrees.

DETAILED DESCRIPTION OF THIS INVENTION

According to one aspect, the present invention is used with a known gas-fired fiber matrix burner, various forms of which are described in the patents above. Such burner is made with a metal body. Such a body can contain side walls and a back wall defining a plenum chamber. A separate partition is secured to the inner interior of the body and partitions the plenum chamber into a combustion mixture plenum surrounding by an air-seal plenum. The partition also separates the combustion mixture plenum into an unbaffled intake compartment in a baffled intake compartment.

The burner can also have an internal support which helps retain the matrix in the burner body and thus reduces the danger of having the matrix blown out by the pressure in its combustion mixture plenum.

According to another aspect of this invention, the invention relates to a new screen which is treated with silicon carbon polymer. Furthermore, the invention relates to a new burner wherein the screen can either be pressure mounted flush to the burner or mounted above the burner without the use of a fastening means such as screws. According to another aspect of this invention, the invention relates to a new matrix which is made from fibers treated with a silicon carbide pre-ceramic polymer and can have various surface shapes to improve the efficiency of the burner.

Figure 1:
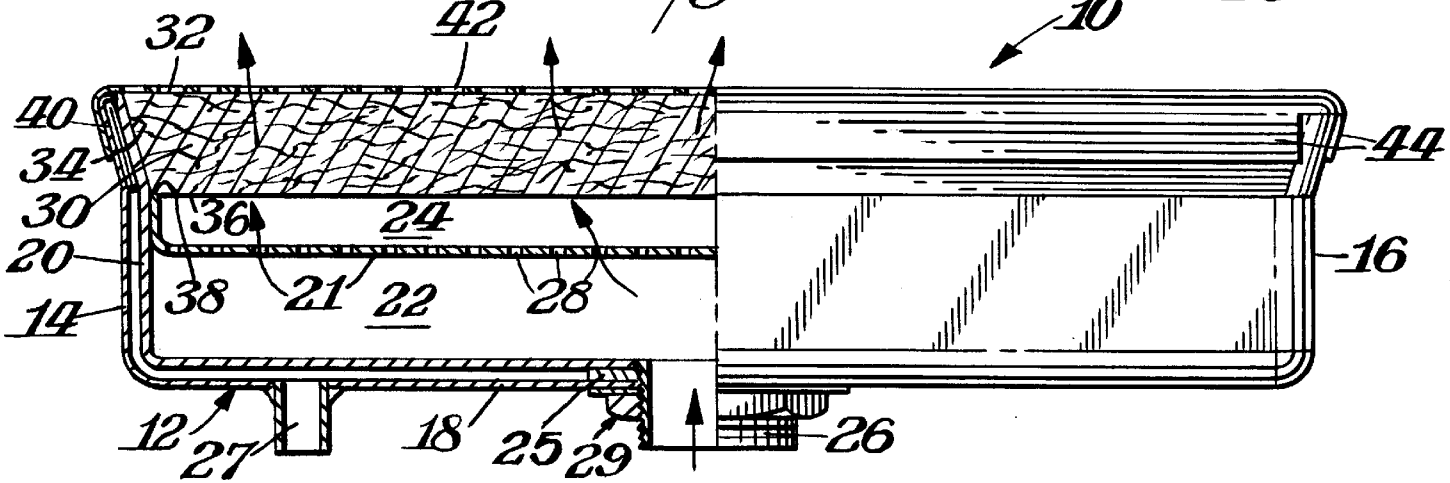
FIG. 1 is a side elevational view, partially in cross-section showing an IR gas fire burner of this invention.

Turning now to the drawings;

FIG. 1 shows a gas fired IR heater 10 which has a metal casing body 12. Body 12 includes side walls, two of which are 14 and 16, integral with a back wall 18 which all define a plenum chamber 20. The plenum chamber 20 has a baffled intake compartment 22 and is unbaffled in compartment 24, for a fuel combustion mixture supplied through a combustion mixture input connector 26 fastened to the back wall 18. A series of openings 28 are provided in the baffle 21 which provides passage of the combustion mixture from compartment 22 to compartment 24. There could be a pipe 27 connected to the metal casing body 12 for pressurizing the space between the body 12 and body 20 with cooling air. There could be a means to hold the outer plenum to the inner plenum such as a spacer and gasket combination 25 with a nut and washer 29 as shown in FIG. 1.

A ceramic fiber matrix 30 which is preferably about 1 inch thick is fitted onto the mouth of chamber 32. If desired, the matrix has its margins cemented against the inner surface of the side walls with a thin layer of silicon adhesive 34. The internal face 36 of the matrix rests against the partition edges 38. This combination is similar to those described in the previous mentioned patents. However, the matrix 30 can be a flat block. In addition, the matrix 30 would be cheaper to make if it is molded. The matrix 30 is a fiber matrix. The fibers are preferably ceramic, metallic or a combination of ceramic and metallic with ceramic being the most preferred. The fibers of the matrix 30 are treated with a silicon carbide pre-ceramic polymer mixture preferably one that contains about 96% SiC, about 2% oxygen, and about 2% carbon. This treatment rigidizes and bonds the ceramic fibers and increases the emittance. One of the preferred polymers used to rigidize the ceramic fibers is AHPCS. AHPCS is a liquid base pre-ceramic polymer that can be purchased from Starfire Systems Inc. AHPCS has a branched structure with nearly 1:1 carbon to silicon ratio with primarily hydrogen substitution, minimizing the formulation of excess carbon during pyrolysis. The viscosity of AHPCS is generally in the range of about 250 to about 8,000 millipoise and a specific gravity of about 0.95. The cure temperature is about 250 to about 400° C. The polymer has a silicone carbon back bone having a weight average molecular weight from 400 to ½ million with a mixed ratio of about 5 to 1 to about 500 to 1 solvent to polymer and not preferably being lower than about 5 to 1. Other polymers that can be used, but do not exhibit as good of a result are Black Glass or CERASET™ from Allied Signal.

The polymer is pyrolyzed at temperatures up to about 1,000° C. preferably from about 800 to about 1,000° C. This is done in an inert gas atmosphere such as nitrogen or argon. The heating rate is up to about 20° C. per minute, preferably up to about 15° C. per minute and most preferably up to about 10° C. per minute. The furnace is cooled at any rate, for example about 2 to about 6 hours. The SiC matrix 30 can improve efficiency because it has a very high emittance and will emit greater amounts of IR energy at lower, more energy efficient, radiant temperatures. The matrix 30 is described in more detail in FIGS. 6–11. Depending on the matrix 30 chosen, it is possible that the IR heater would not need a screen.

Each of the compartments 22 and 24 needs only to be about ⅜ to about 1½ inch in depth, for the IR heater having faces which are as wide and as long as about 1 foot by about 5 feet containing a single combustion mixture. Having those compartments deeper than about ⅝ inch adds unnecessary metal to the body and is not preferred even for the wider or longer burners. The body wall thickness should be at least about 75 mils thick, to provide the extra stiffness helpful for burners having faces as large as about 1 foot by about 12 feet.

Insulation 40 can separate the IR heater body 20 and the two side walls 14 and 16. The insulation 40 can be a folded ceramic fiber insulation. The insulation 40 would increase the efficiency of the burner by preventing heat loss from the matrix 30 to the two side walls 14 and 16.

A screen 42 can be placed on top of the matrix 30. The screen 42 can be in the form of a frame having a grid structure made of fiber, cloth, or fiber and cloth. The screen 42 is treated with a silicon carbide forming polymer. The screen 42 has preferably about 30% to about 70% open mesh. The screen is treated with silicon carbide forming mixture preferably one that contains about 96% SiC, about 2% oxygen, and about 2% carbon. This treatment rigidizes and bonds the fibers. The screen would be more resistant to abrasion and would have a higher emittance. One of the preferred polymers used to rigidize the ceramic fibers is AHPCS. Other polymers that can be used, but do not exhibit as good of a result are Black Glass and CERASET™ from Allied Signal. Other techniques such as chemical vapor inviltration (CVI) can be used, but the cost and uniformity are not as advantageous as AHPCS.

The polymer is pyrolized at temperatures up to about 1,000° C. preferably from about 800 to about 1,000° C. This is done in an inert gas atmosphere such as nitrogen or argon. The heating rate is from up to about 15° C. per minute. The furnace is cooled at any rate, for example about 2 to about 6 hours.

The screen 42 would provide a high emittance above about 0.9. The treated screen 42 would emit more energy over the same surface area. Therefore, the same energy would require a lower temperature which would reduce the pollution, and improve the efficiency.

The screen 42 could be placed flat on the burner or raised away from the burner up to 10 millimeters away from the burner. The screen wires may alternatively be positioned on a 45° angle from parallel with the burner sides. This would minimize the wire length on long burners to reduce the effect of expansion and contraction due to heating and cooling. FIG. 1 shows that the screen 42 is flat on the burner. The outer edges 44 of the screen 42 that fit over the burner can be tapered inwardly to enable the screen 42 to be pushed into place over the burner to provide a snug fit. The screen 42 would be held on to the burner by pressure. The outer edges 44 would function like a skirt clamp and hold the screen 42 into place on the burner 10. The screen 42 would be removable for easy replacement and would not require the use of a fastening means such as screws or the like. Clamping the screen 42 onto the burner 10 would avoid additional hardware. Any additional hardware used in the burner could cause additional maintenance problems.

Figure 2:
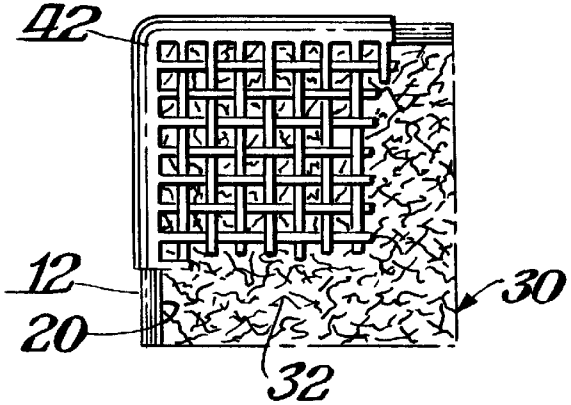
FIG. 2 is a fragmental plan view showing one corner of the burner as shown in FIG. 1.

FIG. 2 shows a fragmental plan view showing one corner of the burner 10 shown in FIG. 1. The surface of the matrix 30 may have a series of peaks and valleys, as later described. The matrix 30 is inside the metal casing 12. The plenum 20 is shown inside the burner. The grid pattern on the ceramic screen 42 is shown in FIG. 2 being on top of the mouth of the chamber 32.

Figure 3:
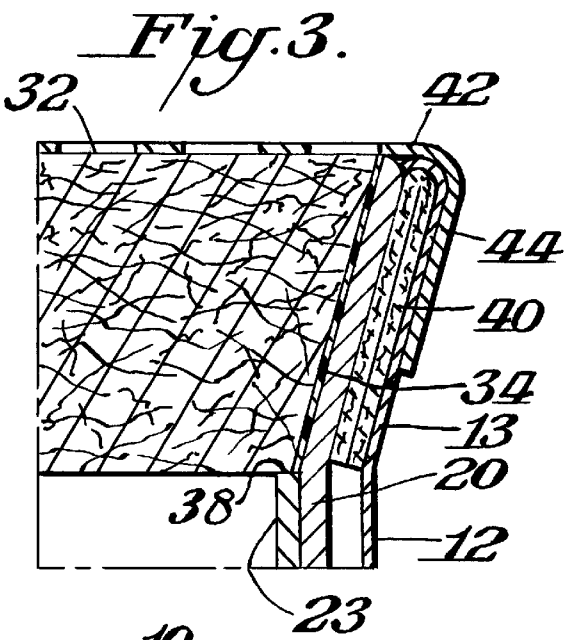
FIG. 3 is a fragmental enlarged side cross-sectional view showing the fiber screen attached to the burner shown in FIGS. 1 and 2.

FIG. 3 shows a fragmental enlarged side cross sectional view showing the fibrous screen 42 attached to the burner shown in FIGS. 1 and 2. In FIG. 3, the silicon carbide treated ceramic fibrous screen 42 is shown being connected flush to the ceramic matrix 30. The outer edges 44 would function like a skirt clamp and hold the screen 42 into place by applying pressure with the outer edges 44 onto the casing 12, in particular to the outer wall of the casing. The outer edges 44 would have to be long enough to ensure enough coverage of the casing 12 so as to hold the screen 42 into place by a pressure fit. The outer edges 44 also must be angled to less than 90° in order to create a pressure fit. The outer edges 44 would be angled in the range of about 50 to about 89° and preferably from about 75 to about 85°. In addition, the installation 40 is shown being in between the metal casing 12 and the plenum 20. The folded insulation 40 retards the conductive heat transfer between the plenum 20 and the metal housing 12. Heat expansion slots 13 can be in the metal housing 12. The slots 13 can be about 1/16 inch on about 1 to about 6 inch centers and could extend from the top curved edge of the housing to about ¼ inch above the bottom edges of the folded insulation 40. A vertical upstanding baffle wall 23 can serve to support ceramic matrix connected to the plenum 20.

Figure 4:
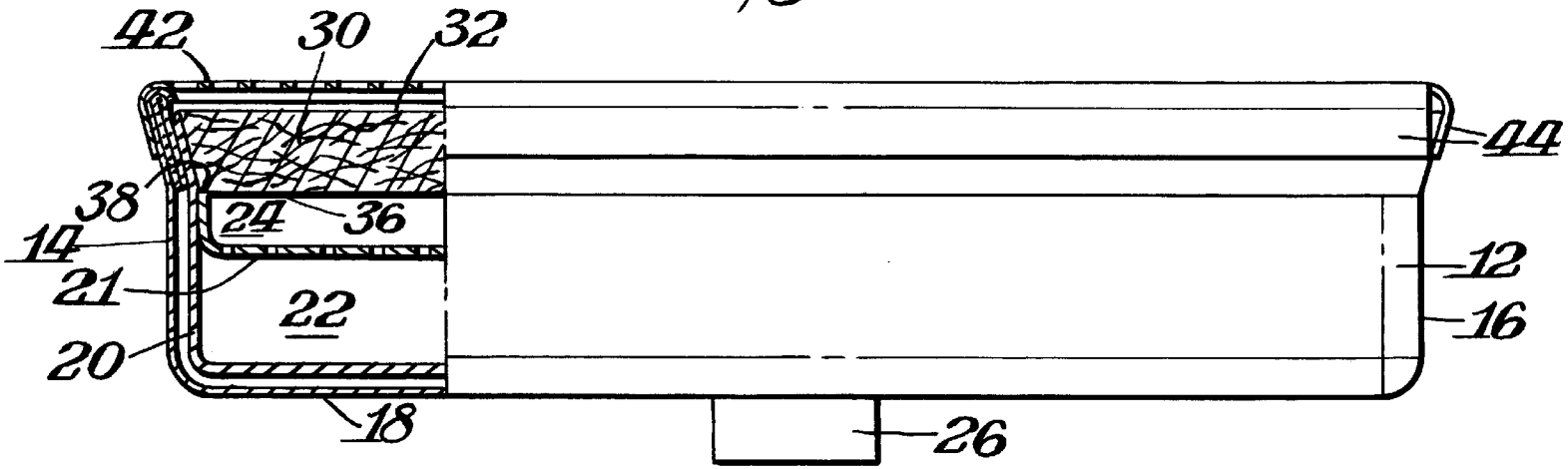
FIG. 4 is a side elevational view, partially broken away to show another burner of this invention.

FIG. 4 shows a side elevational view partially broken away of another burner of this invention. The difference of this burner and the burner in FIG. 1 is that the screen 42 is spaced away from the matrix 30. The matrix 30 would seat inside the mouth of the chamber 32 and would not be flush to the upper edge of the outside wall 14. In other words, the wall 14 would extend outwardly beyond the top surface of the matrix 30. The screen could be clamped into place with a clamp 44 that is connected to the screen 42 or the clamp 44 could be an extension of the screen as discussed above in FIGS. 1–3. The screen could be from about 1 to about 10 mm further away from the outside surface matrix 30. As discussed above the screen would be press fit onto the casing 12 without the additional hardware being required to secure the screen 42 into place.

Figure 5:
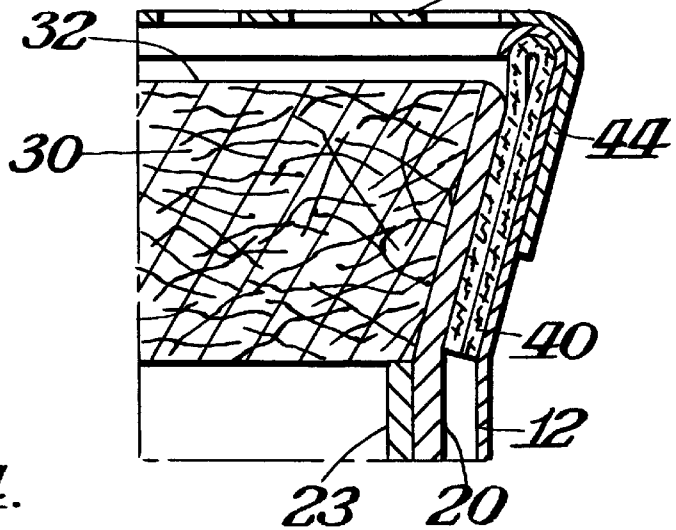
FIG. 5 is a fragmental enlarged side cross-sectional view of the corner of FIG. 4.

FIG. 5 shows a fragmental enlarged side cross-sectional view of the corner of FIG. 4. In particular, FIG. 5 illustrates the screen 42 being located a distance such as between about 1 to about 10 mm away from the top of the matrix 30. The insulation 40 would be located between the metal casing 12 and the plenum 20. The insulation 40 could be a ceramic fiber which would retard the conductive heat transfer between plenum 20 and housing 12.

Figure 7:
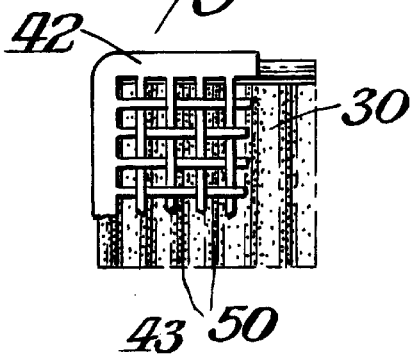
FIG. 7 is a fragmental top plan view showing one corner of FIG. 6.
Figure 6:
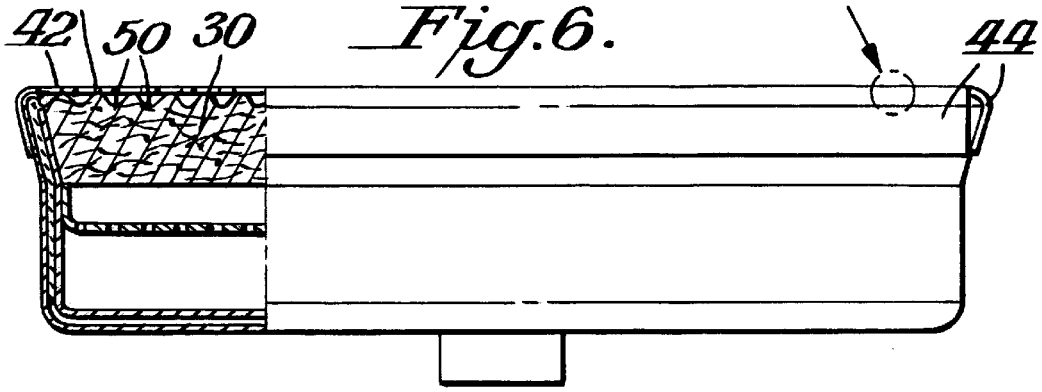
FIG. 6 is a side elevational view, partially in cross-section showing still another burner of this invention.

FIGS. 6 and 7 show a side elevational view partially in cross-section of still another burner of this invention. FIGS. 6 and 7 show the matrix 30 being convoluted. There would be a series of parallel convolutes having peaks 43 and valleys 50 in the matrix 30. The top of the peaks 43 would be in contact with the screen 42.

Figure 8:
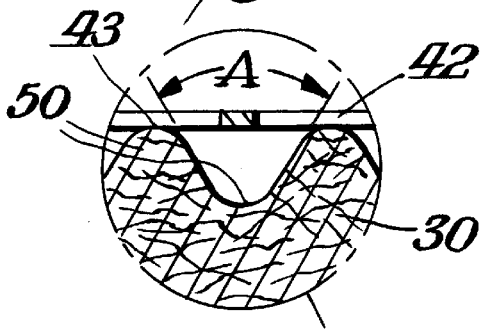
FIG. 8 is an enlarged read out from FIG. 6 showing pore gated matrix detail.

FIG. 8 shows an enlarged read out from FIG. 6 showing a corrugated matrix detail. A is the angle of convolute which would be from about 60 to about 120° and preferably about 90°. The peak 43 is in contact with the screen 42. The screen 42 is located on top of the peaks 43. The valleys 50 in the matrix 30 surface are also shown in FIG. 8.

Figure 9:
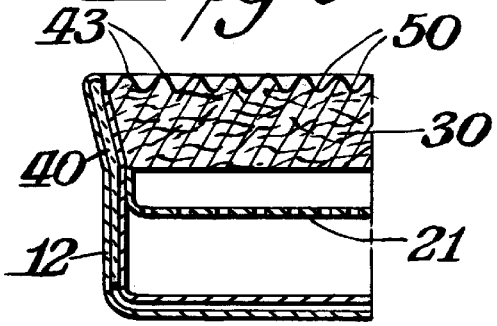
FIG. 9 is a fragmental side elevational view of a further embodiment of the burner of this invention.

FIG. 9 shows a fragmental side elevational view of a further embodiment of the burner of this invention. The gas fired IR heater is similar to that as described above for FIG. 1 except for the this embodiment does not contain the screen 42 as depicted in FIG. 1. In matrix 30 the peaks 43 and the valleys 50 are again illustrated. However, a screen is not located on top of the peaks 43.

Figure 11:
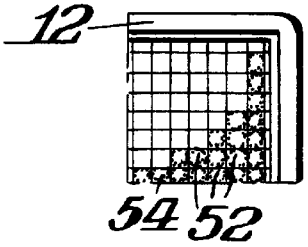
FIG. 11 is a fragmental top plan view of FIG. 10.
Figure 10:
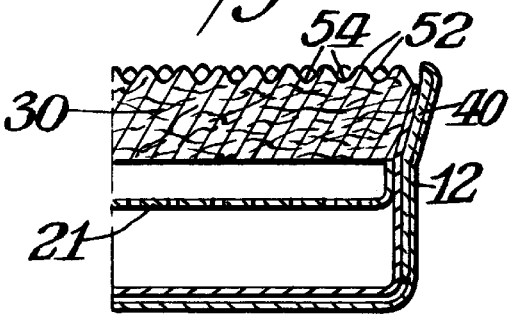
FIG. 10 is a fragmental side elevational view of a still further embodiment of the burner of this invention.

FIGS. 10 and 11 show a matrix 30 being double convoluted. One of the preferred embodiments has the matrix 30 offset. There would be a series of valleys 54 and ridges 52. The convolutes would be parallel with a set 90° offset between each convolute. The matrix would look like a checker board having a ridge 52 appearing in every valley 54.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described. The examples illustrate representative products and are given by way of illustration only and are not to be considered as being limiting.

We claim:

1. In an infrared heater containing a gas fired burner having a metallic burner body with a combustion plenum chamber, and a matrix covering the combustion plenum chamber wherein the improvement comprises said matrix comprising a matrix body made of fibers treated with a pre-ceramic polymer containing silicon and carbon.

2. The heater as claimed in claim 1, wherein said gas fired burner is screenless.

3. The heater as claimed in claim 1, wherein said plenum chamber has a wall and the heater further comprises a ceramic insulation between the metallic burner body and the matrix in order insulate the wall of the plenum chamber and said metallic burner body.

4. The heater as claimed in claim 1, which further comprises a screen mounted flush on said matrix.

5. The heater as claimed in claim 1, which further comprises a screen spaced above said matrix and not flush with said matrix.

6. The heater as claimed in claim 1, wherein said matrix body has at least one exposed convoluted surface shape that is corrugated and having angles in the corrugate from about 60 to about 120°.

7. The heater as claimed in claim 1, wherein said matrix body has at least one convoluted surface and said convoluted surface has ridges and valleys and said at least one convoluted surface of said matrix used for a heater is double convoluted having said ridges in said valleys.

8. A matrix for use in a radiant gas burner which comprises a matrix body made of fibers treated with a pre-ceramic polymer containing silicon and carbon and said matrix is used in a radiant gas burner and said matrix body has at least one exposed convoluted surface shape that is corrugated and having angles in the corrugate from about 60 to about 120°.

9. A matrix for use in a radiant gas burner which comprises a matrix body made of fibers treated with a pre-ceramic polymer containing silicon and carbon and said matrix is used in a radiant gas burner wherein the surface of the matrix is double convoluted having ridges and valleys wherein said ridges are in said valleys.

10. In gas infrared burner having a metallic body with a combustion plenum having a chamber and a matrix which covers the combustion mixture plenum chamber, wherein the improvement comprises a screen connected to the plenum by a press fit without additional structure being required to secure the screen into place.

11. The burner as claimed in claim 10, where in the screen has fibers which are treated with a preceramic polymer containing silicon an carbon at temperatures up to about 1,000° C. in an inert gas atmosphere.

12. The burner as claimed in claim 11, wherein fibers are heated at a heating rate from up to about 15° C. per minute.

13. The burner as claimed in claim 11, wherein said polymer is a branched structure with nearly 1:1 carbon to silicon ratio with primarily hydrogen substitution, minimizing formulation of excess carbon during pyrolysis, having a viscosity in the range of about 250 to about 8,000 millipoise, a specific gravity of from about 0.95 to 0.99, a cure temperature is about 250 to about 400° C. and having a weight average molecular weight from about 400 to about ½ million with a mixed ratio of about 5 to 1 to about 50 to 1 solvent to polymer.

14. The burner as claimed in claim 10, which further comprises ceramic insulation between the metallic body and the matrix.

15. The burner as claimed in claim 10, wherein the screen is mounted flush on said matrix.

16. The burner as claimed in claim 10, wherein the screen is spaced above said matrix and not flush with said matrix.

17. The burner as claimed in claim 10, wherein said matrix comprises a body made of fibers and said fibers are treated with a pre-ceramic polymer containing silicon and carbon and has a convoluted surface shaper having angles in the corrugate from about 60 to about 120°.

18. A radiant gas burner matrix which comprises a matrix body made of fibers treated with a pre-ceramic polymer containing silicon and carbon and said matrix body permits a gaseous combustion mixture to pass through said matrix body and as said mixture emerges, said mixture is burned to heat emerging surface to incandescene.

* * * * *

UNITED STATES PATENT AND TRADEMARK OFFICE

CERTIFICATE OF CORRECTION

PATENT NO. : 6,190,162 B1
DATED : February 20, 2001
INVENTOR(S) : Thomas M. Smith It is certified that error appears in the above-identified patent and that said Letters Patent is hereby corrected as shown below:

Claim 17, Column 8, Line 2, change "shaper" to --shape--.

Signed and Sealed this

Fifth Day of June, 2001

Nicholas P. Godici

NICHOLAS P. GODICI

*Acting Director of the United States Patent and Trademark Office*

*Attest:*

*Attesting Officer*